United States Patent [19]

Bell

[11] 3,999,409

[45] Dec. 28, 1976

[54] SKI LOCK

[76] Inventor: Sterling W. Bell, 706 Rocklyn Drive, San Antonio, Tex. 78239

[22] Filed: July 23, 1975

[21] Appl. No.: 598,516

Related U.S. Application Data

[62] Division of Ser. No. 436,398, Jan. 25, 1974, Pat. No. 3,905,214.

[52] U.S. Cl. ..... 70/58; 70/19

[51] Int. Cl.[2] ..... E05B 73/00

[58] Field of Search ..... 70/57, 58, 19, 4, 18; 280/11.37 A, 11.37 C, 11.37 E, 11.37 K, 11.37 R; 16/171, 172, 173, 174, 175, 178, DIG. 13; 211/60 SK

[56] References Cited

UNITED STATES PATENTS

| | | | |
|---|---|---|---|
| 2,133,883 | 10/1938 | Aubert | 280/11.37 |
| 2,549,110 | 4/1951 | Michael | 16/172 X |
| 3,275,160 | 9/1966 | Zurker | 70/58 X |
| 3,643,810 | 2/1972 | Highberger | 211/60 SK |
| 3,754,420 | 8/1973 | Oellerich | 70/58 |

*Primary Examiner*—Robert L. Wolfe
*Attorney, Agent, or Firm*—H. Ross Workman; J. Winslow Young

[57] ABSTRACT

A locking device for securely engaging a pair of snow skis with sliding surfaces juxtaposed. The lock comprises a pair of ski encompassing jaws pivotally connected at one end and lockable at the other end. The jaws may be separable at the pivotal end and may also include an integral securement device for securing the lock to a post, rack or the like.

5 Claims, 2 Drawing Figures

SKI LOCK

This is a division of application Ser. No. 436,398, filed Jan. 25, 1974, now U.S. Pat. No. 3,905,214.

BACKGROUND

1. Field of the Invention

This invention relates to a locking device for securely engaging a pair of skis together and may include a device for securing the lock to a third object.

2. The Prior Art

With the increased emphasis upon skiing as a recreation, there has been a corresponding increase in theft of skis. Generally, skis are removed from where the owner or user has temporarily deposited them, usually at rest or refreshment areas adjacent ski slopes or from automobile racks with removal being accomplished, for example, by a person exchanging a less valuable pair of skis for the more valuable pair of skis and then skiing or walking away with the newly acquired skis. To thwart this practice, it has become customary for skiers to use various ski restraining devices; for example, see U.S. Pat. Nos. 3,636,739; 3,742,740; 3,461,696; and 3,727,934.

The first reference above discloses a device having at least two separate parts which combine to securely engage the skis. Bulk is thereby increased and the chances of the parts becoming separated are greater. The latter three references disclose ski locking devices which require the physical alteration of the skis before the devices can be used to lock the skis.

It would therefore be desirable to provide a ski locking device which is compact and thus easily portable, unitary to preclude loss of one part, and adaptable for noninjuriously securing a pair of skis to a third object.

BRIEF SUMMARY AND OBJECTS OF THE INVENTION

The present invention is a ski locking device for rigidly clamping a pair of skis with their sliding surfaces juxtaposed. A pair of skis, unidirectionally oriented and with their respective sliding surfaces juxtaposed, present a profile wherein a segment of the skis immediately to the rear of the upturn exhibits, in cross section, the smallest combined cross-sectional area for the pair of skis so placed. This segment extends for a relatively short distance rearwardly. Beyond this segment, the combined cross-sectional area of the skis increases from the greater thickness of each ski and also from the reverse curvature of each ski wherein the skis arc away from each other. Accordingly, a portable lock which rigidly clamps and closely encircles the skis at the foregoing segment of smallest combined cross-sectional area will securely engage one ski to the other. Any attempt to slide one ski relative to the other and through the lock will be firmly resisted since each ski either increases in cross-sectional area or has a relatively short radius curvature which prevents movement of the ski through the lock.

It is, therefore, an object of this invention to provide improvements in the art of securing a pair of skis.

It is another object of this invention to provide a unitary ski locking device that is compact and relatively lightweight for ease of carrying.

It is another valuable object of this invention to provide a ski lock which snugly engages a pair of skis at their point of smallest combined cross-sectional area.

It is an even further object of this invention to provide a ski locking device having an integral securement device for permitting securement of the ski lock to another object.

It is an even still further object of this invention to provide a ski locking device which securely engages a pair of skis to each other in the absence of alteration of the skis.

It is an even still further object of this invention to provide a method for securing together a pair of skis.

It is an even further object of this invention to provide a ski locking device having an integral combination lock.

These and other objects and features of the present invention will become more fully apparent from the following description and appended claims taken in conjunction with the accompanying drawing.

DETAILED DESCRIPTION OF THE PREFERRED EMBODIMENTS

In General

Figure 1:
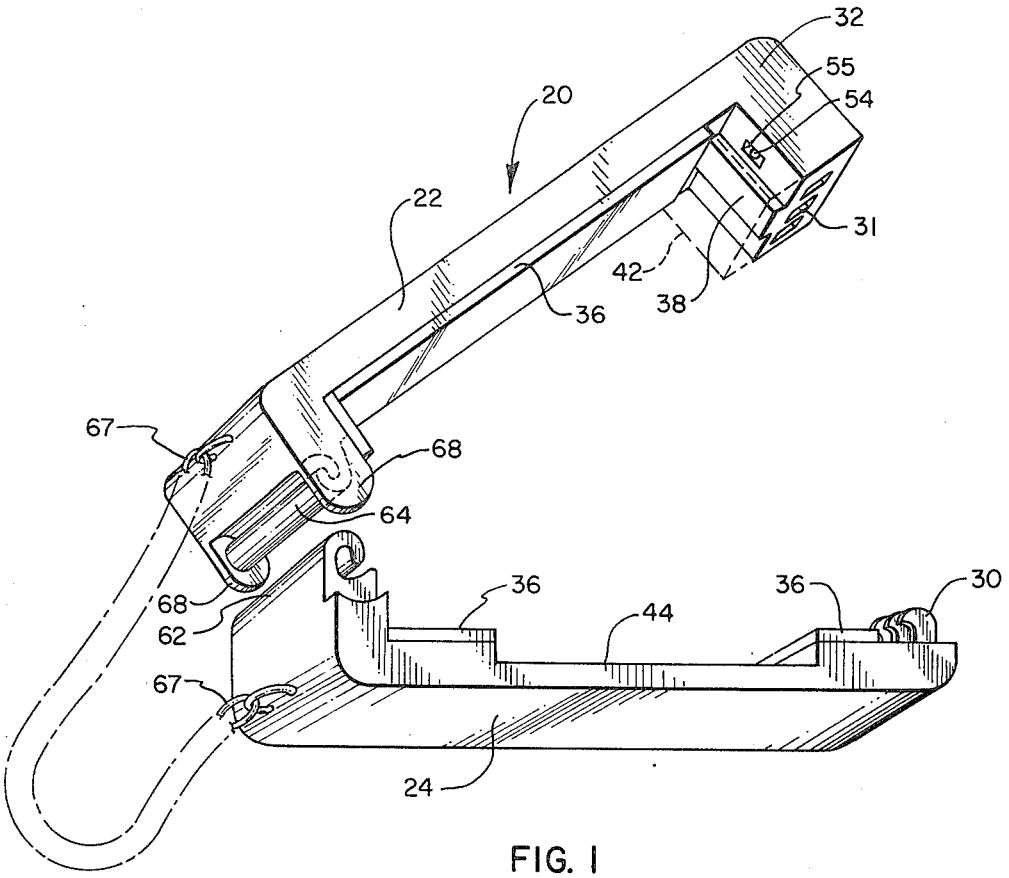
FIG. 1 is a perspective view of the ski lock embodiment of this invention with a chain attachment at the hinge end, the hinge being shown in uncoupled relation.

The invention is best understood by reference to the Figures wherein like parts are designated with like numerals throughout.

Skis have a uniform width but a variable cross-sectional area and curvature along their length to give the skis the desired flexibility. A close-fitting lock 20 placed on a pair of skis immediately behind the upturn of the skis engages the skis at their point of smallest combined cross-sectional area. With lock 20 being snug-fitting and rigid, the skis are firmly held and it is impossible to move the lock 20 from its locked position without damaging the skis. Movement of either ski in a forward or a reverse direction relative to the lock is prevented since each ski increases in cross-sectional area in either direction from where the lock is placed.

Ski lock 20 comprises two rigid jaws 22 and 24 hinged at one end and dimensionally adapted to snugly encircle a pair of skis at a point of least combined cross-sectional area. A bracket receiving slot 44 in either jaw 22 or 24, shown here in jaw 24, adapts the ski lock 20 to receive a fixed bracket not shown, in addition to the skis, to thereby secure the skis to the bracket not shown.

In the locked position, lock engaging prongs 30 (shown in broken lines) engage matching locking members (not shown) of a combination lock 32. A plurality of numbered combination actuating wheels 34 are rotatable to present a plurality of possible lock combinations. Conventionally, the lock combination is selectively preset to release lock engaging prongs 30 when the wheels are rotated to the preset combination position.

Felt pads 36 desirably line a portion of all ski contacting interior faces of jaws 22 and 24 to preclude injury to the skis 23 and 25. A spline 38 on an interior face of jaw 22 serves to engage a keyway of a spacer block 42. The spacer block normally is interposed in a receiving area adjacent spline 38 as shown in broken lines in FIG. 1. Jaw 22 is adapted to receive spacer blocks of varying thicknesses to enable lock 20 to accommodate skis of varying widths.

Conventionally, a reset lever 54 enables the owner of the lock to readily alter the lock combination to any preselected combination setting of his choosing. Lever 54 is operable in a recess 55 in an internal face of bracket 22 to preclude tampering with the lock mechanism. Internal mechanism of lock 32 prevents alteration of the combination unless the lock is opened. The feature of lever 54 is presently commercially available.

Figure 2:
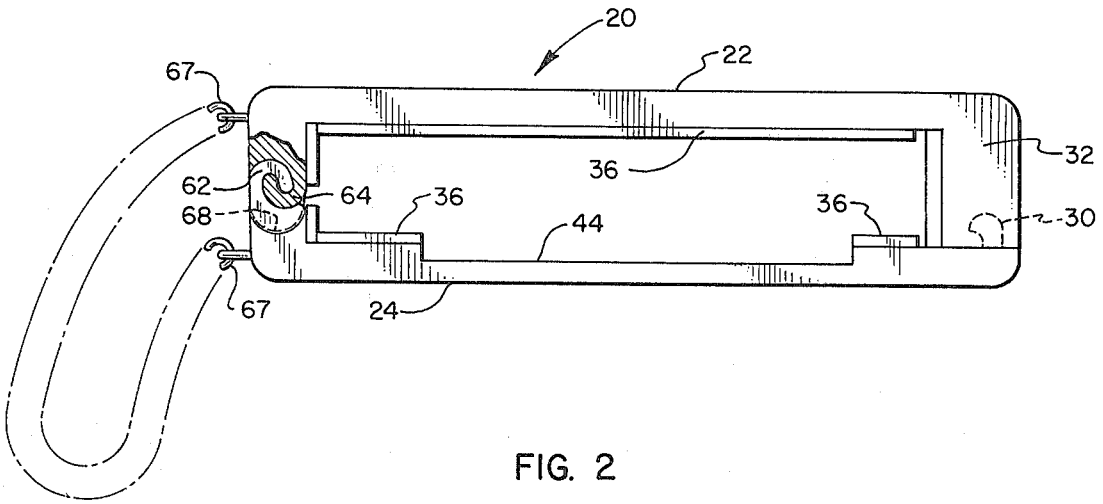
FIG. 2 is the side elevational view of the embodiment of FIG. 1 in coupled relation.

The Embodiment of FIGS. 1 and 2

Referring to FIGS. 1 and 2, a further hinge embodiment is shown whereby jaws 22 and 24 cooperate in hinged relation through a discrete arcuate distance from the closed position and are thereafter separable. Interlocking extensions 62 and 64 of jaws 22 and 24, respectively, are adapted to receive each other in interlocking relationship when lock 20 is closed. Movement of shackles 22 and 24 beyond the discrete arc, upon opening of ski lock 20, permits separation of extensions 62 and 64 and, consequently, jaws 22 and 24.

Being thus separable, and with an end of a chain 67 attached to each of jaws 22 and 24, lock 20 permits facile securement of the skis together and, if desired, securement to a stationary object with either chain 67 or notch 44 about bracket. Complete separation of jaw 22 from jaw 24 is prevented by chain 67.

Lateral movement of extensions 62 and 64 parallel to the axis of rotation is prevented by side members 68, one being broken away and shown in broken outline to more clearly reveal extension 62 and the cooperation between extensions 62 and 64.

The bracket receiving slot 44 addition, the lock to engage a bracket along with the skis to thereby secure the skis to the bracket. In addtion, the integral chain 66 or 67 permits facile securement of the lock to a post, rack, or other such fixed object. Resistance to unauthorized removal and/or separation of skis 23 and 25 is therefore governed by the strength of ski lock 20 and/or chain 66 or 67.

The ski lock disclosed herein has the additional advantage in that it secures the pair of skis in their conventional carrying position, that is, with both skis unidirectionally oriented and placed with their sliding surfaces in contact. With both skis securely bound to each other by the lock, the skis are easily carried as a single unit.

Advantageously, the ski lock of the present invention is compact and is thus easily portable yet strong enough to resist the unauthorized separation of the skis. Attempts at separation will, in all probability, result in damage to the skis.

Use of the ski lock, even in the absence of the restraining chain or its non-use, will serve as a deterrent to unauthorized removal of the skis. Removal of the ski lock, without unlocking the same, will require extensive effort in secrecy and the use of tools. Even under these conditions damage to the skis will, in all probability, occur, thus serving as a realistic deterrent to unauthorized removal of the skis since it would be undesirable for a person to damage the goods that he went to great risk to obtain.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hand-portable ski locking device for securing a pair of snow skis together with sliding surfaces juxtaposed, said locking device being dimensionally adapted to fit in close fitting relationship around the skis and comprising two interlockable metal jaws, said jaws cooperating in a hinge relationship through a discrete arcuate distance from a locked position and thereafter being separable by further arcuate movement; the jaws being interlockably engageable at a first end to provide a rigid clamp when engaged about a pair of skis and being lockable by having an integral combination locking device at a second end of said jaws, the jaws including side members at said first end to inhibit lateral movement of said jaws in a direction parallel to the axis of rotation of said hinge relationship when the jaws are engaged in said hinge relationship.

2. A ski locking device as defined in claim 1 wherein said jaws are tethered to each other.

3. A method for securing a pair of skis together comprising the steps of:

obtaining a pair of hand-portable jaws dimensionally configurated to clamp a pair of skis at their position of least combined cross sectional area when the skis are unidirectionally oriented with their sliding surfaces juxtaposed;

providing one end of the jaws with extensions which cooperate in hinged relation from a closed position through a discrete arcuate distance and are thereafter separable;

inhibiting lateral movement of the extensions in a direction parallel to the axis of rotation of the jaws by placing side members adjacent the extensions;

adapting the jaws to accommodate skis of different widths by selectively inserting a removable spacer block on an internal face of said jaws, the spacer block having a preselected thickness;

orienting the skis unidirectionally with the sliding surfaces in contact;

clamping the skis with the jaws by bringing the extensions together in hingeable interlocking relationship and arcuately closing the jaws about the skis at their position of least combined cross sectional area; and locking the jaws.

4. A method as defined in claim 3 wherein said clamping step includes attaching one end of a tether to each of said jaws and encircling a fixed object with the tether prior to bringing the extensions together in hingeable interlocking relationship thereby tethering said ski lock to a fixed object.

5. A method as defined in claim 3 wherein said locking step includes placing a combination lock as an integral part of said jaws.

* * * * *